US007893331B2

(12) United States Patent
Klanner

(10) Patent No.: US 7,893,331 B2
(45) Date of Patent: Feb. 22, 2011

(54) MUSIC STRING

(75) Inventor: Franz Klanner, Vienna (AT)

(73) Assignee: Thomastik-Infeld Gesellschaft m.b.H., Vienna (AT)

( * ) Notice: Subject to any disclaimer, the term of this patent is extended or adjusted under 35 U.S.C. 154(b) by 41 days.

(21) Appl. No.: 12/258,931

(22) Filed: Oct. 27, 2008

(65) Prior Publication Data

US 2009/0183620 A1 Jul. 23, 2009

Related U.S. Application Data

(60) Provisional application No. 60/983,364, filed on Oct. 29, 2007.

(30) Foreign Application Priority Data

Oct. 29, 2007 (AT) ..... A 1750/2007

(51) Int. Cl.
*G10D 3/02* (2006.01)

(52) U.S. Cl. ..... 84/297 S

(58) Field of Classification Search ..... 84/297 S, 84/297 R, 267
See application file for complete search history.

(56) References Cited

U.S. PATENT DOCUMENTS 6,528,709 B2 * 3/2003 Hebestreit et al. ..... 84/297 S

* cited by examiner

*Primary Examiner*—Kimberly R Lockett
(74) *Attorney, Agent, or Firm*—Henry M. Feiereisen; Ursula B. Day

(57) ABSTRACT

A music string (1), in particular for bowing and/or plucking instruments, wherein the music string (1) has at least one core (2) including at least a first core element (3), and wherein the music string (1) has at least one wrap (4), which is arranged around the first core (2), in particular in a helicoid manner. In order to adapt the characteristics of a stringed musical instrument to changed circumstances and/or in order to avoid problems of a stringed musical instrument without having to keep a great number of different music strings in stock, it is proposed that the music string (1) has first means (5) to change its vibration and/or sound and/or handling characteristics in a predefined manner.

36 Claims, 1 Drawing Sheet

MUSIC STRING

Figure 1:
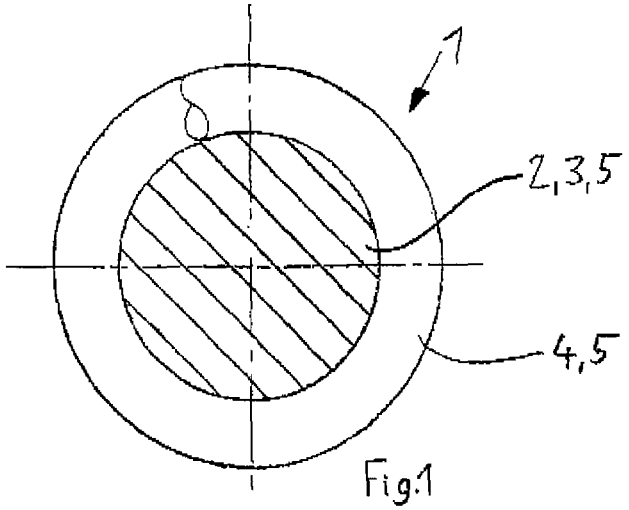

The invention relates to a music string in accordance with the preamble of patent claim 1.

A variety of different music strings is available on the market. In part, these music strings differ greatly from each other with respect to their acoustic and play-technical characteristics. In view of the big differences between different stringed musical instruments, this variety of different music strings is necessary in order to meet the musical and play-technical requirements of the musician. In actuality, many stringed musical instruments meet the requirements of the musician only with a certain kind of music strings. Therefore, as a rule, the musician is dependent on certain music strings for his individual instrument. This results in the disadvantage that, in the emergency of a broken string, not just any replacement string can be strung on the instrument. If the replacement strings are missing, then this can lead to aborting a concert.

Furthermore, stringed musical instruments, in particular bowed instruments, have the characteristic to react very strongly to their respective environment, in particular to temperature and humidity. Often times, this leads to the phenomenon that stringed instruments change their sound and/or handling characteristics very much when they change places and/or when the weather changes. This can lead to a "sudden" occurrence of wolf tones and buzzing tones, which results in the instrument not being playable in many cases. For example, it is a known phenomenon that otherwise unproblematic violins exhibit wolf tones when they are moved from one city to another city. It is known that such changes of the stringed instruments can be avoided and/or offset by changing the music strings. However, this forces the musician in advance to have an entire series of different music strings ready in order to be prepared for all contingencies or to surrender to his/her fate in an emergency.

It is therefore an object of the invention to provide a music string of the above-mentioned kind that avoids the mentioned disadvantages, with which the characteristics of a stringed musical instrument can be adapted to changing circumstances, and with which problems of a stringed musical instrument can be avoided without having to keep a great number of different music strings in stock for this purpose.

In accordance with the invention, this is achieved by the features of patent claim 1.

In this way, the characteristics of a music string can be influenced and/or changed by the musician to a predefined degree even after it is manufactured. As a consequence, the musician can adapt the characteristics of the music string and, thus, the characteristics of his instrument too to changing circumstances. Thus, problems associated with a musical instrument, are caused by, e.g., a location change, a weather change and/or switching the bow, and can be brought under control again by a predefined change of the sound and/or handling characteristics of the music string, without having to keep a great number of different music strings in stock for this purpose. In this way, after switching the musical instrument, the sound and/or handling characteristics of the entire new musical instrument can be at least approximated to the sound and/or handling characteristics of the old musical instrument that the musician is already familiar with. The sound and/or the handling characteristics of music strings can be adjusted in subtly nuanced intervals and are not tied to the sound and/or handling characteristics of individual types of music strings. As a consequence, music strings with subtle nuances can be provided, which exhibit a greater spectrum in terms of their sound and/or handling characteristics than all currently available types of music strings.

The sub-claims, which are, just like patent claim 1, simultaneously part of the disclosure, relate to further advantageous embodiments of the invention.

Figure 2:
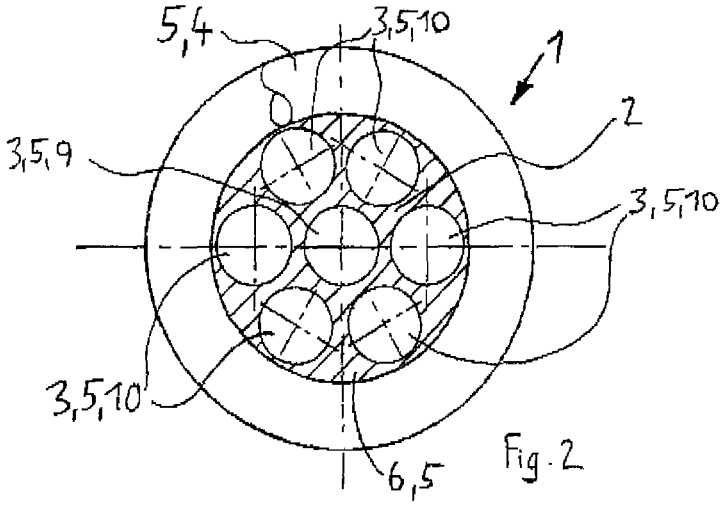
Figure 3:
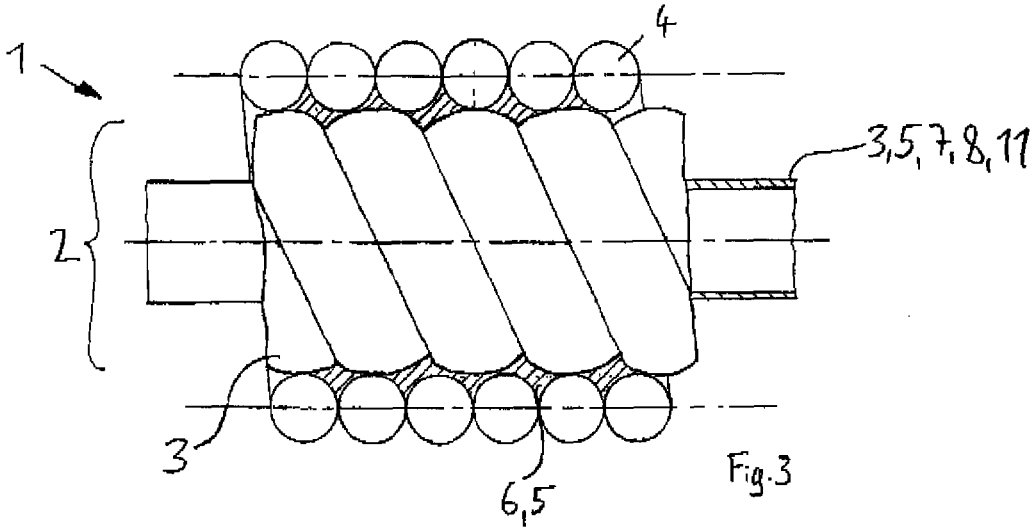

The invention is described in more detail with reference to the drawings, which illustrate merely examples of preferred embodiments. It is shown in:

FIG. 1 a section view of a first particularly preferred embodiment of the music string in accordance with the invention;

FIG. 2 a section view of a second particularly preferred embodiment of the music string in accordance with the invention; and FIG. 3 a section view of a third particularly preferred embodiment of the music string in accordance with the invention.

FIGS. 1 to 3 show a music string 1, in particular for bowed instruments and/or plucked instruments, wherein the music string 1 has at least one core 2 that includes at least one first core element 3, and wherein the music string 1 has at least one first wrap 4, which is wound, in particular in a helicoid manner, around the first core 2, wherein the music string 1 has first means 5 for a predefined change of its vibration and/or sound and/or handling characteristics.

In this way, the characteristics of a music string 1 can be influenced and/or changed by the musician to a predefined degree even after it is manufactured. As a consequence, the musician can adapt the characteristics of the music string 1 and, thus, the characteristics of his instrument too to changing circumstances. Thus, problems associated with a musical instrument, which are caused by, e.g., a location change, a weather change and/or switching the bow, can be brought under control again by a predefined change of the sound and/or handling characteristics of the music string 1, without having to keep a great number of different music strings in stock for this purpose. In this way, after switching the musical instrument, the sound and/or handling characteristics of the entire new musical instrument can be at least approximated to the sound and/or handling characteristics of the old musical instrument 1 that the musician is already familiar with. The sound and/or the handling characteristics of music strings 1 can be adjusted in subtly nuanced intervals and are not tied to the sound and/or handling characteristics of individual types of music strings 1. As a consequence, music strings 1 with subtle nuances can be provided, which exhibit a greater spectrum in terms of their sound and/or handling characteristics than all currently available types of music strings.

Such music strings 1 may be preferably used for instruments of the violin family, i.e., a violin or fiddle, a viola, a cello, and a bass and/or a bass fiddle. Further preferred instruments to be used with the strings according to the invention are guitars and mandolins. Fundamentally, such strings according to the invention may be provided for all bowed and plucked string instruments, such as, cembalos, harps, banjos, sitars, dulcimers, citterns, lutes, Ud, P'I-P'a, gekkin, balalaika, Vina, Tampura, Koto, Soh, etc.

Music strings 1 in accordance with the invention are provided for inducing tone-generating vibrations, wherein a music string 1 is intended for use with a certain musical instrument. Further, music strings 1 in accordance with the invention feature a tone pitch and a so-called standard musical weight. The tone pitch is the tone with which one part of the music string 1—between its end areas—from the length of the scale of the musical instrument, for which the music string 1 is intended, vibrates, when the music string 1 is loaded with the tone weight and thus tensed.

In accordance with the invention, the vibration behavior and/or the sound and/or handling characteristics of a music string 1 according to the invention can be changed, after its production or manufacture, to a predefined degree by a predefined treatment so that by the actions of, e.g., a musician the vibration behavior and/or sound and/or handling characteristic of the music string 1 can be changed in a predefined way. Thus, the music string 1 in accordance with the invention is different before its treatment than the same music string 1 after its treatment so that it exhibits predefined changed vibration and/or sound and/or handling characteristics. In order to prove that the vibration and/or sound and/or handling characteristics changed due to the treatment, the same predefined test conditions must be used.

Preferably, the term "vibration characteristics" means any vibrational or acoustic behavior, e.g., different fade-in behavior, fade-out behavior, tone color spectrum and/or partial tone distribution, etc. Thus, preferably, different vibration characteristics already exist when the vibration characteristics of the music string 1 before the treatment are different from its vibration characteristics after the treatment in only one predefined parameter.

Preferably, the term "handling characteristics" means the characteristics of the music string 1 that a musician can feel during playing, i.e., how the music string 1 reacts and/or feels when it is induced by a bow or the finger; the feeling when shortening the effective tone-generating length by the finger; or, e.g., the feeling in the hand that guides a bow. Further, the term "handling characteristics" means play-technical characteristics of the music string 1, e.g., how quickly the music string 1 reacts to a switch of the bow and/or how quickly a desired vibration can be induced by the musician and, thus, how long the fade-in process takes until a stable vibration state is achieved when the inducement is done by a bow.

Preferably, the term "same test conditions" mentioned above means that the music string 1 according to the invention is tested under first test conditions before its predefined treatment, and that the same music string 1 is again tested under the identical first test conditions after its treatment. Test conditions can differ in, e.g., the tone weight and, thus, the tension of the music string 1; the ambient temperature; the humidity; the kind of inducement, e.g., bowing or plucking; the measurement variable; the way of measuring the measuring variable, and much more. For example, it can be preferably provided to string the music string 1 on a monochord that has a bridge which includes a piezo-electric sensor, and to induce this music string 1 by plucking and to measure the fade-out behavior and the partial tone distribution in order to determine its vibration behavior in this way. However, other test conditions may be provided too.

Generally, with respect to the predefined change of the vibration and/or sound and/or handling characteristics of music strings 1 in accordance with the invention, mechanical parameters of the respective music strings 1 too are changed, such as the bending stiffness and/or the torsion stiffness; the attenuation, in particular the inner attenuation; the E-modulus; the shear modulus; the rigidity; the diameter and/or the mass distribution, etc. However, musical instruments are typically more sensitive than most measurement devices so that even changes, which are today hardly measurable or not measurable at all with conventional measurement technology, can already lead to sound changes in a significantly perceivable way, due to the music string 1 in accordance with the invention.

The predefined treatment of music strings 1 in accordance with the invention can include a great variety of different treatments, wherein each kind of treatment of a music string can be provided by which a music string in accordance with the invention experiences a predefined change in its vibration and/or sound and/or handling characteristics. In the following, merely six particularly preferred methods for treating music strings 1 in accordance with the invention are described. Therein, when the particularly preferred constructive embodiment of music strings 1 in accordance with the invention is described, the respective method for treating music strings 1 in accordance with the invention is provided, which leads, in the respective embodiment, to a particularly excellent and advantageous change of the vibration and/or sound and/or handling characteristics of the respective music string 1.

In a preferred first method for treating music strings 1 in accordance with the invention, the music string 1 is twisted-in and/or twisted-out to a predefined degree prior to stringing the musical instrument, which can be particularly easily realized when stringing a stringed musical instrument.

In a preferred second method for treating music strings 1 in accordance with the invention, the music string 1 is stretched to a predefined degree prior to stringing the musical instrument, in particular by loading the music string 1 with a predefined force. This can be easily realized by hanging the music strings and loading them with a predefined mass. The time period of the force action can also be predefined.

In a preferred third method for treating music strings 1 in accordance with the invention, the music string 1 is thermally treated to a predefined degree prior to or after stringing the musical instrument. In particular, the music string 1 is warmed up or cooled down. This can be done by, e.g., an arrangement of the music string 1 in an oven and/or a freezer for a time period that is preferably predefined. In special embodiments of the third method, the cooling can also be provided through dry ice and or liquid gases, in particular liquid nitrogen and/or liquid helium. A warming up of the music string 1 in the sense of the invention can also be achieved by kneading the music string 1 with the fingers and/or by generating frictional heat, e.g., by pulling the music string 1 between the fingers or in a cloth.

In a preferred fourth method for treating music strings 1 in accordance with the invention, an electric current of predefined electric voltage, predefined amperage, predefined frequency and/or predefined signal form flows through the music string 1 for a predefined time period, prior to or after stringing the musical instrument. Preferably, this can be done by connecting the music string 1 to an accumulator or a battery, but also by connecting the music string 1 to a power source unit or signal generator. In this respect, the relevant electric safety instructions must be complied with.

In a preferred fifth method for treating music strings 1 in accordance with the invention, the music string 1 is pulled, preferably with a predefined force, over an edge having a predefined edge radius, prior to stringing the musical instrument. The musician can execute this method too on-site, easily and quickly. In a great number of embodiments of music strings 1 in accordance with the invention, which are further described below, this method leads to very good results of the predefined change of their vibration and/or sound and/or handling characteristics

.

In a preferred sixth method for treating music strings 1 in accordance with the invention, the music string 1 is exposed to a predefined magnetic field, at least area by area. This method has the particular advantage that it can also be applied to music strings 1 which are already stringed onto a musical instrument. As a result, this method is particularly suitable for retroactive and reversible sound changes at a music string 1 according to the invention.

Music strings 1 in accordance with the invention have first means 5 for the predefinable change of their vibration and/or sound and/or handling characteristics in order to reach the characteristic of the predefined change of their vibration and/or sound and/or handling characteristics. A great number of different embodiments and/or designs of these first means 5 are described below. Unless expressly noted, any combination of the respective individually described embodiments and designs of the first means 5 can be provided. To ensure lucidity and clarity of the disclosure, a notation system is introduced due to the great number of embodiments and/or designs of the music strings 1 and/or the first means 5: A first classification is made according to preferred embodiments, wherein each embodiment is further classified according to the preferred design of the same embodiment. Therefore, in the following, a distinction between "embodiment" and "design" is made. Moreover, to facilitate understanding, a classification is inserted at the appropriate place, by means of which the embodiment and the design are designated by Roman numerals in parentheses. For example, if the third design of the fourth embodiment is described, then this is indicated in the text by (IV:III), wherein the first number describes the embodiment and the second number describes the design. If merely an embodiment without further, special design is described, then this is indicated by showing the number of the embodiment followed by a period and a "0" as placeholder.

Music strings 1 according to the invention can be embodied differently. The music strings 1 according to the invention have a core 2, which is wrapped, in particular in a helicoid manner, by at least one wrap 4 or winding.

The core 2 of a music string 1 according to the invention can include any material selected from the group of: metals, in particular steel and/or titanium, synthetic fibers such as carbon fibers, glass fibers, polymer fibers, in particular polyamide, aramide fibers, PEK, PEEK, PBT, polyester, nylon, polyethylene, PET, PEET, PES, PE, PP, POM, PTFE, PVDF, PVD and/or PVC. The material can also include any plant-based and/or animal-based fiber, such as silk and/or natural gut. It is particularly preferable that the core 2 includes steel, and in particular carbon steel (C-content from 0.01% to 0.03%) and chromium-nickel steel (Cr content from 17% to 20%, Ni-content from 8% to 10%), aramide fibers and/or nylon fibers. In addition, the core elements 3 can be coated with a polymer and/or a metal, such as titanium.

The core 2 may be embodied as a single first core element, i.e., as a single wire and/or a single fiber. Preferably, the core 2 can have a predefined plurality of core elements 3 that can be intertwined and/or stranded, wherein any number of intertwined and/or stranded core elements 3 may be provided. Thereby, the individual core elements 3 may have a predefined shape and a predefined cross section. In particular, the cross-section of at least one core element 3 may be round or may be the segment of a circle or a polygon, such as a triangle, a hexagon and/or a trapezoid. However, combinations with respect to the material and the shape of the cross section of differently embodied core elements 3 can also be provided in a core 2.

Furthermore, music strings 1 according to the invention have at least one first wrap 4, which is preferably wrapped around the core 2 in a helicoid manner, and which, primarily, serves for application of a predefined mass coating. Unless described differently in the designs and embodiments below, the at least one wrap 4 includes, in particular, gold, silver, nickel, steel and aluminum. Also, preferably two, three, four, or five wraps 4 can be wrapped on top of each other or into each other. Coated wires can be provided too. Moreover, the first wrap 4 can preferably have plated wires, wherein, particularly preferably, connection wires, such as coated plated wires and/or plated multiple-coat wires may be provided. Particularly preferably, first wraps 4 are made of plated core wires selected from the group of: Cu, Ni42, steel, W, which have a sheathing selected from the group of: Cu, Ag, Au, wherein the following combinations deliver particularly excellent results: core including W—sheathing including Cu, core including Cu—sheathing including Ag, core including Ni 42—sheathing including Cu, core including steel—sheathing including Cu, core including Cu—sheathing including Au.

Further, a so-called thread covering is provided at least one end of the music string 1. Particularly preferably, the music string 1 has a first thread covering at its first end, and a second thread covering at its second end, which protects the music string 1 from excessive edge loading when it is stringed at the pins of a musical instrument. The often colored thread coverings, which are made from synthetic and/or natural fibers and/or an elastic coating that is applied by, e.g. immersing the first and/or second end of the music string 1 in an immersion bath, further facilitate the identification of the different music strings 1.

In a first preferred embodiment (I.0) of the present invention, the first means 5 include the first core element 3, and the first core element 3 includes at least a first material. In a second preferred embodiment (II.0) of the present invention, the first means 5 include the first wrap 4 and the first wrap 4 includes at least a first material. In this way, by suitable selection of the first material, a music string 1 can be provided which experiences, due to a predefined treatment, a predefined change of its vibration and/or sound and/or handling characteristics. As a consequence, music strings 1 can be provided that are hardly different from known music strings 1 in terms of their structure and, thus, their production. This means that the production and/or manufacture of such music strings 1 is very simple because it can be based on already known and implemented manufacturing techniques.

In a particularly preferable first design of the first and/or the second embodiment (I.I) (II.I), the first means 5 have at least one shape memory alloy and/or particularly the first material is embodied as a material with shape memory characteristics, in particular as a metallic shape memory alloy, preferably as a shape memory alloy selected from the group of: nickel-titanium, copper-zinc, copper-zinc-aluminum, copper-aluminum-nickel, iron-nickel-aluminum, nickel-titanium-iron, nickel-titanium-copper, copper-zinc-silicon, copper-zinc-gallium, indium-titanium, gold-cadmium. By using a first material having shape memory characteristics, music strings 1 can be provided that react especially to the treatment in accordance with the third and fourth preferred method for treating music strings 1.

As already explained, the core element 3 can have a predefined number of a plurality of core elements 3 or all core elements 3, which are embodied in accordance with the first design of the first embodiment (I.I). In this way, characteristics, in particularly the rigidity of the core 2, and, thus, in particular the bending stiffness of the music string 1 can be influenced in a predefined way, which has a direct effect on the type of formation of a so-called "Helmholz corner" and, thus, directly on the type and distribution of the overtones of the sound generated by the respective music string 1. Further, the bending stiffness has a direct effect on the form of the energy output of the music string 1 at the bridge of a musical instrument and the respective influence of a string holder.

In accordance with a first design of the second embodiment (II.I), the at least one wrap 4 of the music string 1 includes a material with shape memory characteristics. In this way, predefined changes can be made as to how strictly the wrap 4 is arranged around the core 2. In this way, the attenuation of the music string 1 and, thus, its handling characteristic can be directly changed under the effect of preferably the third and/or the fourth method. Furthermore, as a consequence, the torsion stiffness of the music string 1 can be changed in a predefined manner.

Depending on the type of shape memory alloy provided in the first design of the first embodiment (I.I) or the first design of the second embodiment (II.I) of the music strings 1 in accordance with the invention, the change achieved can be reversible or non-reversible. In accordance with a second design of the first and/or second embodiment (I.II) (II.II), the first material can be material that experiences irreversible structural change when it exposed to predefined thermal, chemical and/or mechanical treatment, which leads, in the respective first material, to a change in the hardening state and/or other mechanical characteristics, for example. Besides the advantages of the above-described first design of the first embodiment (I.I) or the first design of the second embodiment (II.I), music strings 1 according to these designs (I.II) (II.II) have the further advantage of low production costs and react particularly advantageously to a treatment in accordance with the third and/or fourth and/or fifth method. In particular, as the first material in accordance with the second design of the first and/or second embodiment (I.II) (II.II), a material is selected from the group of martensitic steels, austenitic steels, perlitic steels, nickel-based alloys, e.g. neumonic or nicotel, cobalt basis alloys.

In accordance with a third design of the first and/or second embodiment (I.III) (II.III), the first material includes at least one carbon-nanofiber. Thus, at least one core element 3 (third design of the first embodiment (I.III)) and/or at least one wrap 4 (third design of the second embodiment (II.III)) have carbon-nanofibers and/or they are made of carbon-nanofibers. The term "carbon-nanofibers" includes both so-called Single-Wall-Carbon-Nanotubes and Multi-Wall-Carbon-Nanotubes, which, as individual elements, have a diameter that is greater than 1 nm. Preferably, composite materials that include carbon-nanofibers and polymers are provided as the first material. Due to the carbon-nanofibers, novel music strings 1 can be formed, which have, primarily, advantages during inducement by bowing. Due to the high heat conductivity of the carbon-nanofibers, the heat generated at the bowing process is quickly transferred from the bowing location, which means that the life expectancy of the music string 1 increases. Under the effect of very high temperatures, the carbon-nanofibers decompose and/or change so that an irreversible change of the amount of carbon-nanofibers in the music string can be achieved by the third and fourth method.

In the area of music strings 1 it is known to arrange at least a first polymer element 6 between the core 2 and the first wrap 4 and/or between the individual core elements 3 by means of which the attenuation of the music string 1 can be influenced. In a third preferred embodiment (III.0) of music strings 1 according to the invention, the first means 5 include the first polymer element 6, and the first polymer element 6 is preferably a first polymer liquid, in particular first oil, by means of which the music string 1 can be dampened. In a particularly preferred first design of the third embodiment (III.I), the first polymer element 6 is a polymer element 6 which experiences an irreversible viscosity change upon predefined thermal, chemical and/or mechanical treatment, by means of which the dampening can be adjust across large ranges. Thus, a music string 1 can be formed, for example, which is dampened to an only very small degree without treatment and, thus, particularly suitable for inducement by plucking, and which is dampened to a very large degree after treatment and, thus, particularly suitable for inducement by bowing. Particularly preferred polymer elements 6 in accordance with the first design of the third embodiment (III.I) are, e.g., varnish, resins and/or glues having a temperature and/or pressure hardening hardener portion. Particularly preferred are, e.g., natural resins, preferably larch resin, spruce resin, colophony, synthetic resin, preferably epoxy resin, phenolic resin, polyester resin, varnish, such as polyamide varnish, glue, such as acryl glue, PVC glue, cyanoacrylate glue, methacrylate glue. Such music strings 1 react particularly advantageously to a treatment in accordance with the second, third, fourth and/or fifth method. It is particularly preferable that the viscosity of the first polymer element 6, and thus the dampening of the music string 1 too, can be adjusted in a predefined manner in predefined intervals by the type of treatment, e.g. the degree of the temperature and/or the effect duration in the third method, as a result of which music strings 1 can be formed that can be used in a particularly versatile range of applications.

In a further development of the first design of the third embodiment (III.I), it is provided in a second design of the third embodiment (III.II) that at least one capsule, in particular a micro-container and/or a nano-container, is arranged in the first polymer element, and that, in the interior of the capsule, at least a second liquid, in particular a polymer liquid, is arranged. Such capsules are know from, e.g., the pharmaceutical industry and/or from skin care products. By the measures described above, a second, preferably visco-elastic polymer liquid can be arranged in the capsules. These liquid-filled capsules can have different effects, depending on the embodiment. To this end, it is particularly preferable that the at least one capsule is embodied such that it breaks after an essentially predefined time period and/or under essentially predefined load conditions and outputs its contents to the environment. Preferably, the second liquid, which is preferably a visco-elastic polymer liquid, is a liquid selected from the group of: oil, preferably natural plant-based oil, mineral oil products and/or synthetic oils, natural resins and/or synthetic resins, in particular epoxy resins, phenol resins, polyester resins, and/or glues. Particularly preferable are multi-part adhesives and/or resins, wherein the resin and/or the glue is arranged in capsules, and wherein the respective hardener is also arranged in capsules. In this way, aging of the music string 1 can be delayed in that the second polymer liquid counteracts the age-related changes of the first polymer 6. The second design of the third embodiment (III.II) reacts especially to the treatment in accordance with the first, second and/or fifth method.

In accordance with a third design of the third embodiment (III.III), the first polymer element 6 and/or the second liquid includes carbon-nanofibers and/or carbon-nanoballs. Preferably, the carbon-nanofibers can be in the form of the different carbon-nanofibers already described in connection with the third design of the first and/or second embodiment (I.III) (II.III). Additionally, or alternatively, so-called carbon-nanoballs can be used, which are also known as Buckyballs (named after the architect Buckminster Fuller) in the English language. The carbon-nanofibers and/or carbon-nanoballs are embedded in the first polymer element 6 and effect an improvement of the heat conductivity of the music string 1. Due to arranging the carbon-nanofibers and/or Buckyballs in the second liquid in accordance with the second design of the third embodiment (III.II) and due to the design of the capsules such that they break open under the local load stress of the bow during the bowing process, it can be achieved that the special heat-discharging effect is effective only at the bowing location. A music string 1 in accordance with the third design of the third embodiment (III.III) reacts especially to a treatment in accordance with the first, second, third and/or fourth method.

In accordance with a preferred fourth embodiment (IV.0) of the present invention, the first means 5 have core changing means 7. By changing the core 2, a great effect can be achieved with small changes. By changing the core 2, primarily damping, overtone contents and the torsion and/or bending stiffness of the music string 1 can be changed. Preferably, the core changing means 7 are embodied as core diameter changing means and/or as means for changing the pre-tension of the core 2.

In accordance with a first design of the fourth embodiment (IV.I), the core changing means 7 have at least a first tube 8 that is arranged in the area of the core 2. In particular, the first tube 8 is arranged in the center of the core 2. In this way, music strings 1 can be formed which react especially well to a treatment in accordance with the fifth method and which are especially suitable for inducement by plucking. During treatment in accordance with the fifth method, an area by area deformation of the first tube 8 can be achieved, wherein, area by area, the vibration and/or sound and/or handling characteristics are changed.

As a further development of the invention, a second design of the fourth embodiment (IV.II) provides that the first tube 8 is made of a first polymer material, which preferably has predefined plastic and/or elastic shape change characteristics. In this way, a change of the core diameter is especially simple, by means of which primarily the handling characteristics and the tone color of the music string 1 are changed. In this context, the music string 1 has preferably pressure changing means, which preferably include a valve and/or a connection for a pump, for changing the interior pressure of the first tube 8. As a result, it is possible to inflate the first tube 8 and, thus, to change both the diameter of the core 2 and the tension within the core 2. Therein, it is a particular advantage that such changes can also be made directly at the music strings 1 which are stringed on a musical instrument and that, furthermore, the diameter and/or tension changes at the core 2 can be essentially continuously regulated.

Generally, music strings 1 have means for hanging the music string 1 at a part of the respective music instrument. In simple embodiments, these hanging means can be a sling or knot of the music string 1. Preferably, the music string 1 is terminated on a first end by a sleeve or ball, which is, in particular, made of metal, and which is generally known as a button. Preferably, the pressure changing means are arranged in the area of the button because, generally, good access for changing the pressure in the interior of the first tube 8 is provided in the area of the string holder even if the music strings 1 are stringed on the musical instrument. Due to the increase of the interior pressure of the first tube 8, the diameter of the first tube 8 is enlarged and, thus, the diameter of the core 2 is enlarged too.

In a further, third design of the fourth embodiment (IV.III), the core changing means 7 have at least an inner core element 9 and at least an outer core element 10, which is arranged around the inner core element 9, and the core diameter changing means 7 further have third means for moving and/or bracing the inner core element 9 in relation to the outer core element 10. Due to this third design of the fourth embodiment (IV.III) too, both a diameter change of the core 2 and a change of the tension in the core 2 can be achieved, by means of which the vibration and/or sound and/or handling characteristics of the music string 1 can be changed in a predefined and essentially continuous manner.

In this context, a combination of the above-described further third design of the fourth embodiment (IV.III) with the first design of the first embodiment (I.I) is particularly preferable because the inner core element 9 and/or the outer core elements 10 include a shape memory material, which is, in particular, made of a material that has shape memory characteristics.

In accordance with another, fifth embodiment (V.0) of the invention, the first means 5 have at least one first magnetically sensitive, and preferably ferromagnetic, material. By using materials with predefined magnetic behavior, it can be achieved that forces act within the music string which lead to an advantageous dynamically-dependent dampening of the music string 1. In a preferred first design of the fifth embodiment (V.I), it is particularly preferable that the first material and/or the first polymer element 6 and/or the second liquid include, at least area by area, the first magnetically sensitive material. Primarily due to arranging the magnetically sensitive material in form of microscopic or macroscopic particles in the first polymer element 6 and/or the second liquid, and due to simultaneous formation of the wrap 4 and/or the core 2 from a magnetically sensitive material, a particularly effective predefined change of the vibration and/or sound and/or handling characteristics of the music string 1 can be achieved. By applying the sixth method for treating music strings 1, this effect can be predefined with respect to both its intensity and its reach. To this end, by treatment in accordance with the sixth method, both the individual magnetic dipoles can be aligned and, e.g., the magnetic particles within the first polymer element 6 and/or the second liquid can be moved and, thus, the mass distribution of the music string 1 across its cross section can be changed. As a result, the amount of torsion vibrations and, thus, of inharmonic tones in the overall sound of the music string 1 can be influenced. Preferably, each type of a magnetically sensitive material can be provided, wherein, in particular, iron and cobalt as well as special permanently magnetic materials, such as alnico, alcomax, feroba and/or neodymium can be provided. Furthermore, purely ferromagnetic materials can be provided, which experience, due to the treatment in accordance with the sixth method, an alignment of the Weiss zones and which, thus, have a resulting magnetic field too.

In accordance with yet another sixth embodiment (VI.0) of the music strings 1 in accordance with the invention, the music string 1 is embodied as a cylindrical capacitor. As a result, due to other physical causes, essentially the same advantages can be achieved as with the music strings 1 in accordance with the fifth embodiment (V.0) or the first design of the fifth embodiment (V.I). Since the charge of a capacitor can decrease over time even it is not purposefully discharged, a preferred first design of the sixth embodiment (VI.I) provides that the first means 5 have at least one voltage source for generating a potential difference between the core 2 and the wrap 4. As a result, by controlling the applied voltage, the effect with respect to the changed vibration and/or sound and/or handling characteristics can be predefined, and this effect can be maintained too. In addition, by changing the applied voltage, a further adaption of the vibration and/or sound and/or handling characteristics of the music string 1 is possible at any time, and in particular during operation. In this way, the character of a violin, for example, can be changed between two different compositions in a quick, replicable, and reproducible manner. It is particularly preferable that, in the case of music strings 1 which have a hanging device for attaching the music string 1 to a string holder of a musical instrument, the voltage source, which is in particular embodied as a battery, is arranged in the area of the hanging device. Therein, the additional mass in the area of the string holder causes additional sound-facilitating characteristics, and, furthermore, simple access to the voltage source is provided.

In a further, seventh embodiment (VII.0), at least the first core element 3 includes, at least area by area, a piezoelectric element. Preferably, the piezoelectric element is arranged, at least area by area, in a tubular core element 11. In particular, the tubular core element 11 is essentially completely filled with the piezoelectric element. As a result, an electric voltage is generated when tone-generating vibrations are induced. As a consequence, in a particularly preferred combination with the sixth embodiment (VI.0) (VI.I) of the present invention, additional voltage sources are not needed in that the piezoelectric element charges the capacitor. Any material having piezoelectric characteristics can be provided as the piezoelectric element. Particularly preferred are carbon-nanofibers and/or Buckyballs, which have, in addition to the already described advantageous characteristics, piezoelectric characteristics too.

Below, three different embodiments of music strings 1 in accordance with the invention are described, which represent the best known embodiments at the time of filing.

FIG. 1 shows a first particularly preferred embodiment of a music string 1 in accordance with the invention. The music string 1 has a core 2 that is formed by a single first core element 3. Further, a single first wrap 4 is wrapped around the core 2 in a helicoid manner. In accordance with the first design of the first embodiment (I.I), the core 2 is made of nickel-titanium, and, in accordance with the first design of the second embodiment (II.I), the first wrap 4 is made of gold-cadmium.

FIG. 2 shows a second particularly preferred embodiment of a music string 1 in accordance with the invention having a so-called rope core that includes seven core elements 3, which include, in accordance with the third design of the first execution (I.III) carbon-nanofibers. A polymer element 6 is arranged between the individual core elements 3 in such a way that it enwraps them. In accordance with the second design of the third embodiment (III.II) of the invention, the polymer element 6 includes a plurality of nano-containers, of which a predefined number is filled with a synthetic resin that is based on epoxy. Another predefined number of nano-containers is filled with a hardener for the synthetic resin that is based on epoxy. The thus formed core 2 of the music string 1 is wrapped in a helicoid manner by a first wrap 4 which meets the first design of the second embodiment (II.I) and which is made of copper-aluminum-nickel.

FIG. 3 shows a third particularly preferred embodiment of a music string 1 in accordance with the invention having a multi-part core 2, which is formed of a first tube 8 in accordance with the second design of the fourth embodiment (IV.II). Stranded further core elements 3 made of PEEK are arranged around the first tube 8. A first polymer element 6 in accordance with the first design of the fifth embodiment (V.I) is arranged between the thus-formed core 2 and a wrap 4 made of a plated copper wire, which has a silver sheathing and whose thickness is in the range of 5% and 25% of the thickness of the plated copper wire. Particles of alcomax are mixed into the visco-elastic polymer liquid that forms the first polymer element 6.

In addition, further constructive measures can be provided at the stringed instruments themselves, in particular at the instruments of the violin family, such as bridges with a changeable and/or adjustable geometry and/or mass distribution, and/or fingerboards whose distance to the music string 1 can be adjusted and/or fingerboards which have incorporated resonance masses.

Within the scope of the invention described and disclosed by the patent claims, any combination of individual embodiments and/or design can be provided, even it is not explicitly described.

Further embodiments in accordance with the invention exhibit merely a portion of the described characteristics, wherein each characteristics combination, in particular of different described embodiments, can be provided.

The invention claimed is:

1. A music string for a bowing and/or plucking instrument, wherein the music string has at least one core including at least a first core element, and wherein the music string has at least one wrap, which is arranged around the at least one first core, wherein the music string has first means configured to allow a player of the instrument to change its vibration and/or sound and/or handling characteristics in a predefined manner.

2. The music string according to claim 1, wherein the first means include the first core element and the first core element includes at least one first material.

3. The music string according to claim 1, wherein the first means include the at least one wrap, and the at least one wrap includes at least a first material.

4. The music string according to claim 1, wherein the first means include at least one shape memory alloy.

5. The music string according to claim 2, wherein the at least one first material is embodied as a shape memory alloy selected from the group consisting of: nickel-titanium, copper-zinc, copper-zinc-aluminum, copper-aluminum-nickel, iron-nickel-aluminum, nickel-titanium-iron, nickel-titanium-copper, copper-zinc-silicon, copper-zinc-gallium, indium-titanium, and gold-cadmium.

6. The music string according to claim 2, wherein the at least one first material is a material which experiences an irreversible structural change when it is exposed to a predefined thermal, chemical and/or mechanical treatment.

7. The music string according to claim 2, wherein the at least one first material includes at least one carbon-nanofiber.

8. The music string according to claim 1, wherein at least one first polymer element is arranged between the at least one first core and the first wrap and/or between the individual core elements, wherein the first means include the at least one first polymer element.

9. The music string according to claim 8, wherein the first polymer element is a polymer element which experiences an irreversible viscosity change when it is exposed to thermal, chemical and/or mechanical treatment.

10. The music string according to claim 8, wherein at least one capsule is arranged in the first polymer element, and that wherein a second, liquid is arranged in an interior of the capsule.

11. The music string according to claim 10, wherein the at least one capsule is embodied such that it breaks open after an predefined period of time and/or under predefined load conditions and outputs its contents to the environment.

12. The music string according to claim 10, wherein the second liquid is a visco-elastic polymer liquid.

13. The music string according to claim 10, wherein the first polymer element and/or the second liquid includes carbon-nanofibers and/or carbon-nanoballs.

14. The music string according to claim 1, wherein the first means include core changing means.

15. The music string according to claim 14, wherein the core changing means include at least one tube that is arranged in the vicinity of the core.

16. The music string according to claim 15, wherein the at least one tube is made of a first polymer material having predefined plastic and/or elastic shape changing characteristics.

17. The music string according to claim 15, wherein the music string has pressure changing means for changing an inner pressure of the at least one tube.

18. The music string according to claim 14, wherein the core changing means have at least one inner core element and at least one outer core element that is arranged around the inner core element, and wherein the core changing means furthermore have third means for moving and/or bracing the inner core element in relation to the outer core element.

19. The music string according to claim 1, wherein the first means include a first magnetically sensitive material.

20. The music string according to claim 10, wherein the first material and/or the first polymer element and/or the second liquid include, at least area by area, a first magnetically sensitive material.

21. The music string according to claim 1, wherein the music string is embodied as a cylindrical capacitor.

22. The music string according to claim 1, wherein first means include at least one voltage source for generating a potential difference between the at least one first core and the wrap.

23. The music string according to claim 22, wherein a hanging device for attaching the music string to a string holder of a musical instrument is arranged at a first end of the music string, and wherein the at least one voltage source is arranged in the vicinity of the hanging device.

24. The music string according to claim 1, wherein the at least first core element includes, at least area by area, a piezoelectric element.

25. A method for treating a music string of a bowing and/or plucking instrument having at least one first core including at least a first core element, at least one wrap arranged around the at least one core, and first means for allowing a player of the instrument to change its vibration and/or sound and/or handling characteristics in a predefined manner, wherein the first means are activated by at least one of twisting the music string to a predefined degree prior to stringing the music string onto a musical instrument, stretching the music string to a predefined degree prior to stringing the music string onto a musical instrument by loading the music string with a predefined force, thermally treating the music string to a predefined degree prior to stringing the music string onto a musical instrument by warming up or cooling down, flowing an electric current having a predefined voltage, predefined amperage, predefined frequency and/or predefined signal form through the music string for a predefined period of time prior to stringing the music string onto a musical instrument, and pulling the music string over an edge having a predefined edge radius with a predefined force, prior to stringing the music string onto a musical instrument, exposing the music string, at least area by area, to a predefined magnetic field.

26. The music string according to claim 1, wherein the at least one wrap is arranged around the at least one first core in a helicoid manner.

27. The music string according to claim 8, wherein the at least one first polymer element is embodied as a first polymer liquid.

28. The music string according to claim 27, wherein the at least one first polymer element is embodied as an oil.

29. The music string according to claim 10, wherein the at least one capsule is embodied as a micro-container and/or a nano-container.

30. The music string according to claim 10, wherein the second liquid comprises a polymer.

31. The music string according to claim 15, wherein the at least one tube is arranged in a center of the core.

32. The music string according to claim 17, wherein the pressure changing means include a valve and/or a connection for a pump.

33. The music string according to claim 19, wherein the magnetically sensitive material is a ferromagnetic material.

34. The music string according to claim 23, wherein the at least one voltage source comprises a battery.

35. The music string according to claim 24, wherein the piezoelectric element is arranged, at least area by area, in a tubular formed core element.

36. The music string according to claim 24, wherein the tubular formed core element is essentially completely filled with the piezoelectric element.

* * * * *